United States Patent [19]

Rojey et al.

[11] Patent Number: 4,680,939

[45] Date of Patent: Jul. 21, 1987

[54] PROCESS FOR PRODUCING HEAT AND/OR COLD BY MEANS OF A COMPRESSION ENGINE OPERATING WITH A MIXED WORKING FLUID

[75] Inventors: Alexandre Rojey, Garches; Claude Ramet, Nanterre, both of France

[73] Assignee: Institut Francais du Petrole, Rueil-Malmaison, France

[21] Appl. No.: 738,218

[22] Filed: May 28, 1985

[30] Foreign Application Priority Data

May 28, 1984 [FR] France ..... 84 08633

[51] Int. Cl.[4] ..... F25B 9/00

[52] U.S. Cl. ..... 62/114; 62/505

[58] Field of Search ..... 62/114, 505, 115, 498, 62/502

[56] References Cited

U.S. PATENT DOCUMENTS

| | | | |
|---|---|---|---|
| 3,300,997 | 1/1967 | Kocher | 62/505 |
| 3,396,550 | 8/1968 | Cawley | 62/505 |
| 4,290,272 | 9/1981 | Vakil | 62/114 |

*Primary Examiner*—Henry A. Bennet

*Attorney, Agent, or Firm*—Millen & White

[57] ABSTRACT

The invention relates to a process for producing heat and/or cold by means of a compression engine operating with a nonazeotropic mixed working fluid. It is characterized in that the mixed working fluid, partially vaporized at the output of evaporator (E1), is contacted, in heat exchange conditions, in (E2), with the compression system (K), in order to continue or complete the vaporization of the fluid which is then compressed, condensed in exchanger (E3), expanded through an expansion valve (V) and then recycled to evaporator (E1).

11 Claims, 6 Drawing Figures

PROCESS FOR PRODUCING HEAT AND/OR COLD BY MEANS OF A COMPRESSION ENGINE OPERATING WITH A MIXED WORKING FLUID

The present invention concerns an improved process for producing heat and/or cold in a plant using compression means, for example a compressor unit, operating with a mixed working fluid. Such a mixed working fluid is a mixture of two or more constituents, at least two of which do not form an azeotrope; at a given pressure, such a fluid vaporizes or condenses depending on a temperature range and not at a fixed temperature.

BACKGROUND OF THE INVENTION

The use of a non-azeotropic mixture in the heat pumps and cooling machines is known in order to improve the thermal capacity or the performance coefficient of the plant. The application of non-azeotropic mixtures has been the object, in particular, of U.S. Pat. Nos.: 4,089,186, 4,344,292 and 4,406,135.

It has been discovered that the use of such mixtures is of particular advantage when the non-azeotropic mixture is only partly vaporized in the evaporator, the completion of the vaporization being achieved by heat exchange with the compressor unit. As a matter of fact, the compressor unit constitutes a heat source generally at a higher temperature than the external fluid cooled in the evaporator; thus, a mixed working fluid which vaporizes according to a temperature profile, may reach, by heat recovery from the compressor unit, a temperature, at the end of the boiling period, higher than that obtained when proceeding to a complete vaporization in the evaporator. The process thus makes it possible to reduce the compression rate of the plant. It also offers the advantage of cooling the gases during the compression step, with the favorable effects of a reduction of the compression work and of a decrease of the discharge temperature.

The selection of the compressor type in a cooling machine or a heat pump essentially depends on its power. Generally, reciprocating compressors are used for suction rates, by volume, lower than 1000 $m^3/h$; screw compressors for volume rates up to 5.000 $m^3/h$ and, for higher rates, turbocompressors are substituted to positive-displacement compressors.

Within the smaller power ranges, hermetic units are widely used. They comprise a steel jacket or bell formed of two welded parts, with extending suction and delivery pipes. The compressor is generally of the reciprocating type but may be also of the rotary type.

The hermetic units have many advantages: protection against external agents, compactness, low acoustic level, low price. The main problem of their use is the high temperature of the gases. As a matter of fact, the sucked gases cool simultaneously the lubricating oil and the motor coils. The design of the compressor itself is thus responsible for a substantial overheating of the gas before admission to the feed values and for a high discharge temperature.

Now, the compression power is the higher as the suction temperature is high. On the other hand, a too high thermal level is a factor of wear of the motor and may limit the condensation temperature as a result of the liability of coolant and lubricant decomposition. In fact, the compression of a gas in a hermetic compressor unit may be considered as substantially adiabatic since all the evolved heat is recovered by the working fluid at the delivery.

The accompanying figures illustrate embodiments of the invention without limiting the scope thereof.

SUMMARY OF THE INVENTION

Figure 1:
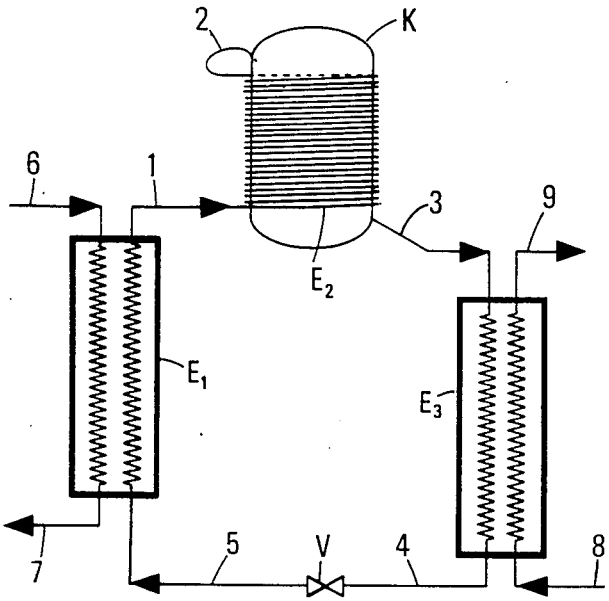
FIG. 1 is a flowsheet of a plant operating according to the invention.

The invention concerns a process for producing heat and/or cold characterized in that (a) a mixed working fluid (M) in liquid state, comprising at least two constituents not forming an azeotrope with each other, is partially vaporized by heat exchange with an external fluid, (b) the liquid-vapor mixture (M) from step (a) is contacted in heat-exchange conditions with a compression system (K) so as to continue or complete the vaporization of step (a), (c) the mixture (M) resulting from step (b) is compressed in the compression unit (K), (d) the compressed mixture (M) from step (c) is condensed by heat exchange with an external fluid and (e) the resultant liquid mixture (M) is expanded and recycled to step (a).

The mixed fluid is a mixture of two or more chemically different compounds and preferably a mixture of halogenated hydrocarbons having 1 to 3 carbon atoms; examples of these fluids are: trifluoromethane $CHF_3$ (R23), chlorotrifluoromethane $CClF_3$ (R13), trifluorobromomethane $CF_3Br$ (R13B1), chlorodifluoromethane $CHClF_2$ (R22), chloropentafluoroethane $CClF_2$—$CF_3$ (R115), dichlorodifluoromethane $CCl_2F_2$ (R12), difluoroethane $CH_3CHF_2$ (R152a), chlorodifluoroethane $CH_3$—$CClF_2$ (R142b), dichlorofluoromethane $CHCl_2F$ (R21), trichlorofluoromethane $CCl_3F$ (R11), trichlorotrifluoroethane $CCl_2FCClF_2$ (R113), and dichlorohexafluoropropane (R216).

At least one of said constituents of the mixture may be an azeotrope of chlorofluorocarbonaceous compounds, a substance having the behaviour of a pure fluid; examples of the main azeotropes to be used are:

- R500: azeotrope or R12/R152a (73.8%/26.2% by weight)
- R501: azeotrope of R22/R12 (75%/25% by weight)
- R502: azeotrope of R22/R115 (48.8%/51.2% by weight)
- R503: azeotrope of R23/R13 (40.1%/59.9% by weight)
- R504: azeotrope of R32/R115 (48.2%/51.8% by weight)
- R505: azeotrope of R12/R31 (78.0%/22.0% by weight)
- R506: azeotrope of R31/R114 (55.1%/44.9% by weight).

The mixed fluids will be preferably a mixture of halogenated hydrocarbons comprising a major constituent having a molar concentration higher than 75%, for example ranging from 75 to 95%, the one or more other constituents forming the complement to 100% of the mixture. The major constituent will be for example R13B1, R22, R502, R12 or R500. Several types of mixtures can be used, for example:

binary mixtures composed of a basic constituent as above mentioned and a minor constituent whose critical temperature is higher; these mixtures generally improve the performance coefficient as compared to the basic constituent used as pure fluid; examples of said binary mixtures are the following:

R22/R114
R22/R142b
R22/R11
R502/R11
R12/R113
R500/R113 binary mixtures composed of a basic constituent as above-mentioned and a constituent of lower critical temperature; these mixtures generally improve the heat capacity as compared with the basic constituent used as pure fluid. Examples are as folows:

R22/R23
R502/R23
R12/R23
R500/R23 ternary mixtures such as:

R23/R22/R114
R23/R22/R142b

An embodiment of the invention consists of cooling externally the compression unit so as to obtain a more isothermal compression than according to the prior art and to reduce accordingly the consumed power. The simplified flowsheet of a plant operating according to the invention is shown in FIG. 1. The mixed working fluid is fed to evaporator E1 through line 5 as liquid or liquid-vapor; it is partially vaporized in E1 by cooling an external fluid forming the heat source, supplied to exchanger through line 6 and discharged therefrom through line 7. The liquid-vapor mixture issued from the evaporator passes through line 1 into exchanger E2, providing heat recovery by exchange with the hermetic compressor unit K; in exchanger E2, the mixture is further or completely vaporized and is optionally overheated up to point 2, corresponding to the suction pipe of the compressor. The working fluid is thendischarged through an outlet pipe of the compressor at point 3. The gas issued from the compressor is then conveyed to condenser E3 wherein it is de-overheated, condensed, preferably completely, and optionally subcooled, up to the outlet point. In exchanger E3 the working fluid transfers heat to an external fluid penetrating in E3 through line 8 and discharged through line 9. Finally, the condensed mixture (line 4) passes through the expansion valve V, wherethrough it is brought to the evaporation pressure.

In practice, the heat pump or the cooling plant may comprise, in addition to the elements shown in FIG. 1, ancillary elements which do not change the general operating mode according to the invention.

When the expansion valve is of the bulb thermostatic type, it is preferably placed on the suction pipe, in order to control the effective overheating at the suction part.

When a capillary is provided for expanding the coolant, a tank is often provided between the evaporator and the compressor, so as to act as an anti-hammer liquid capacity and as liquid accumulator; in this arrangement, the accumulator will be serially connected between the output of heat recovery exchanger E2 and the compressor suction pipe. Similarly, when the engine is provided with a cycle reversing valve, the operating conditions are maintained inasmuch as the heat exchanger E2 and the suction pipe are sequentially connected in series in the circuit.

Figure 2:
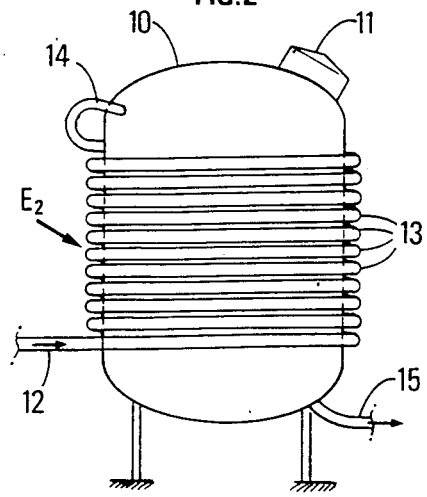
FIGS. 2 to 6 show different possible embodiments of exchanger E2. Said exchanger E2 provides for heat recovery by exchange with the hermetic compressor unit.

Various embodiments of exchanger E2 can be considered. A first embodiment consists of pipes helical winding about at least a portion of the compressor casing (FIG. 2). The shape of the turns of the pipes will be preferably adapted to provide a maximum contact surface with the casing of the unit. Generally, the latter has a cylindrical shape with rounded bases; the exchange tubes are then preferably shaped as half-circles with straight internal edge. FIG. 2 shows a hermetic compressor having a suction pipe 14 and a delivery pipe 15, a casing 10 and an electric box 11. According to said arrangement, the mixed working fluid enters exchanger E2 through line 12, then circulates through the different joined turns 13, wound around this unit. The direction of fluid circulation and the arrangement of the tubes are adapted to the location of the suction and delivery pipes. The passage cross-sectional area of the exchange tubes will preferably be at least equal to that of the connection pipe from the evaporator, in order to provide a correct return of the circulating oil towards the compressor.

According to another embodiment of exchanger E2, at least a portion of the compressor is enclosed in a tight jacket; the latter forms a second casing such that the annular cross-sectional area between the two walls is constant. When the compressor unit is cylindrical, the peripheral casing will be a concentric cylinder. Such an arrangement has the advantage of a direct contact between the working fluid at the end of the evaporation step and the walls of the compressor. In a preferred arragnement baffles are provided to form a channel for the fluid circulation and avoid liquid and oil accumulation in the lower part of the annular space.

Figure 3:
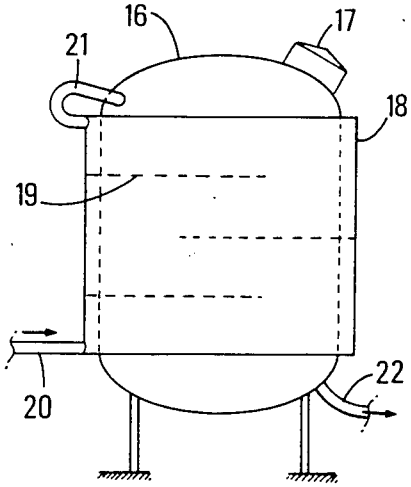

FIG. 3 shows a hermetic compressor having a casing 16 and an electric box 17 and surrounded with a concentric casing 18. In this arrangement, the mixture flows between horizontal baffles such as 19 in staggered arrangement, shown in dotted line. The working fluid enters the annular exchanger through line 20; it flows out, completely vaporized and optionally overheated, through suction line 21, is compressed and then discharged through line 22. In an alternative embodiment of the preceding device, the mixture passageway may be defined by vertical baffles in staggered arrangement in the exchange zone, according to the same principle.

The considered baffles have for object only to form a channel for the flow of coolant and do not require perfect tightness between the different passageways.

During the vaporization of the non-azeotropic mixture according to the process of the present invention, the temperature evolves, whereas, on the contrary, for a pure substance, the temperature remains constant during the vaporization.

In a preferred embodiment of exchanger E2, the mixed working fluid supplied to said exchanger comes into heat-exchange contact with the walls of the compression system at a point relatively close to the suction zone of the compression system; it circulates around said compression system while progressively flowing closer to the discharge zone. The path followed by the mixed working fluid around the compression system is preferably helical. During its progression towards the discharge zone, the mixed working fluid progressively vaporizes. Said fluid, which is completely vaporized at the output of exchanger E2, at a point relatively close to said discharge zone, is then fed to the suction zone of the compression system.

In this preferred embodiment of the invention, the point at which the mixed working fluid comes into heat exchange contact with the compression system is such that exchanger E2 always covers at least one part of the zone located in the vicinity of the discharge point. Exchanger E2 generally covers at least 50% of the zone between the suction point and the delivery point and, preferably, at least 75% of said zone. In an advantageous embodiment, the exchanger E2 entirely covers the zone in the vicinity of the discharge point.

Figure 4:
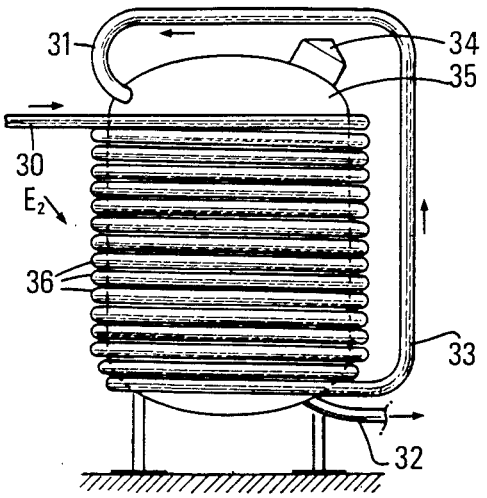
Figure 6:
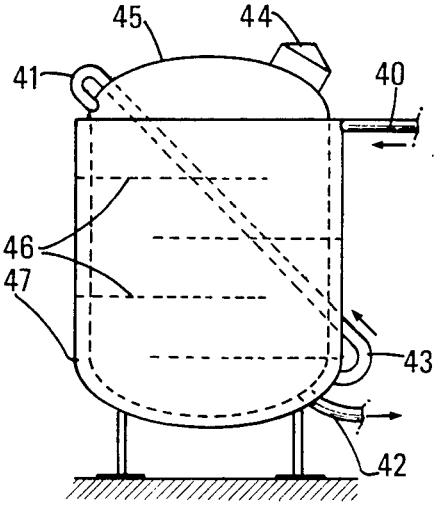
Figure 5:
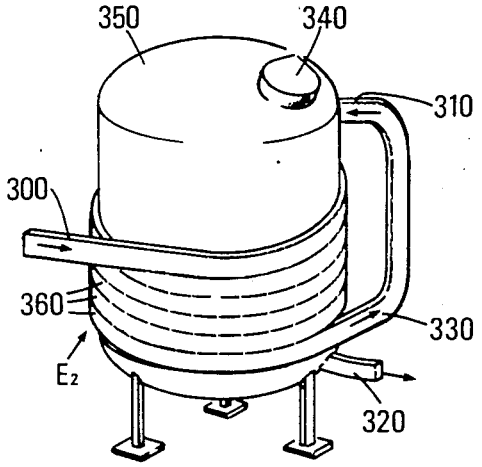

The preferred embodiment of exchanger E2 is illustrated in FIGS. 4, 5 and 6.

FIG. 4 shows an exchanger E2 formed by helical winding of tubes around the compression casing. FIG. 4 shows a hermetic compressor having a suction orifice 31 and a discharge orifice 32, a casing 35 and an electric box 34. According to this arrangement, the mixed working fluid enters exchanger E2 through line 30 and then circulates through the joined turns 36 wound around the unit. The mixed working fluid is discharged from exchanger E2 at a point close to the level of the discharge orifice 32, through line 33, leading to the suction orifice 31.

FIG. 5 shows an exchanger E2 formed by helical winding of tubes of square section wound on the lower part of the compressor casing 350. The exchager E2 covers about 50% of the zone between the suction orifice 310 and the discharge orifice 320. The zone in the vicinity of the discharge orifice is widely covered. The mixed working fluid enters exchanger E2 through line 300, circulates through the joined turns 360 around the unit and is discharged at a point close to the level of the discharge orifice 320, through line 330, leading to the suction orifice 310. The electric box 340 is secured to the unit casing 350.

The exchange may also take place between a peripheral jacket 47 and the compressor casing 45: FIG. 6 is a schematic view illustrating this arrangement. The jacket 47 surrounds the whole compressor zone in the vicinity of the discharge orifice 42 and covers the compressor practically up to the level of the suction orifice 41. Horizontal baffles 46 are provided so that the mixed working fluid follows a helical path starting from a point close to the level of the suction orifice 41. The mixed working fluid is fed through line 40 and flows out at a point close to the discharge orifice 42, through line 43 leading to the suction orifice 41. The electric box 44 is secured to the casing 45 of the unit.

With a helical winding of joined turns, it is advantageous to use tubes having a section shaped so as to provide a maximum contact with the casing of the unit; tubes having a half-circle section with internal straight edge are preferred and tubes of rectangular or square cross-section having more intimate contact with each other and with the unit, are more preferred.

All the turns are serially traversed but each of the turns may consist of several tubes mounted in parallel.

When the heat exchange takes place between a peripheral jacket and the casing of the compressor unit, the latter may have an extended surface as compared to a smooth surface, in order to increase the exchanger area. The casing of the compressor unit will, for example, be provided with fins or grooves or may have corrugated walls. More generally, any external shape or the casing resulting in an increase of the exchange surface as compared with a smooth casing will be used advantageously.

On the other hand, the compressor casing may be covered with a coating destined to favour the nucleation and formation of steam bubbles of the mixture and to increase the exchange surface; the coating may, for example consist of porous or sintered material.

EXAMPLES

The following examples illustrate the application of the invention to a heat pump.

Example 1 (according to the prior art)

A heat pump of the water/water type, used for domestic heating, recovers heat, for example, from the water of a well and heats the return water from the heaters. In the evaporator where the whole working fluid is evaporated, water is cooled down from 10° C. to 6° C., whereas at the condenser the heating water temperature varies from 42° C. to 50° C. The reciprocating compressor and the motor are contained in a hermetic unit; the latter contains a single cylinder having a delivery rate of 9.5 $m^3/h$ at the nominal motor speed. Under normal operating conditions, the gas passing through the compressor cools the oil and the coils of the motor; in these conditions, the compression is substantially adiabatic and hence all the heat losses are dissipated in the discharged gases. Such an operating mode results generally in high discharge temperatures. When the working fluid is a non-azeotropic mixture containing 85% by mole of monochlorodifluoromethane (R22) and 15% by mole of dichlorotetrafluoroethane (R114), in the preceding conditions, the mixture has a suction temperature of 7.7° C. and a discharge temperature of 105° C.

Example 2 (according to the invention)

The compression unit of example 1 is now provided with a cooling system placed between the evaporator output and the compressor input. The hermetic unit is a cylinder of 22 cm diameter whose upper and lower faces are rounded and whose median height is 34 cm. The cooling exchanger is a stacking of joined turns of half-circle section, wound around the hermetic unit according to the diagram of FIG. 4 and whose exchange surface with the latter is 0.15 $m^2$. According to this arrangement, the mixture is only incompletely vaporized in the evaporator; the vaporization is completed, followed with an overheating, in the cooling exchanger. The latter provides for a substantial decrease of the discharge temperature and also of the compression power (see Table 1). On the other hand, the end of the evaporation step performed in the auxiliary exchanger increases the temperature at the end of the mixture boiling step, thus leading to a lower compression rate.

Practically, the discharge temperature is 75° C. and the cooling of the compressor requires 505 W, i.e. 12.2% of the power taken at the evaporator.

Table I below gives a comparison of the characteristics of the heat pump according to the two operating modes of the compressor.

TABLE I

| CASE | ADIABATIC COMPRESSION | COMPRESSION WITH COOLING |
|---|---|---|
| Thermal power delivered by the heat pump (W) | 6261 | 5703 |
| Power consumed by the compressor (W) | 1932 | 1597 |

TABLE I-continued

| CASE | ADIABATIC COM-PRESSION | COMPRESSION WITH COOLING |
|---|---|---|
| Performance coefficient | 3.24 | 3.57 |
| Discharge temperature (°C.) | 105 | 75 |
| Suction Pressure (bars) | 3.92 | 4.10 |
| Discharge pressure (bars) | 17.68 | 17.40 |
| Compression rate | 4.51 | 4.24 |

The increase of the performance coefficient results from the temperature decrease during compression and from the ending evaporation of the mixture achieved by heat recovery from the compressor; this last factor makes possible a substantial decrease of the compression rate.

In the considered example, the vaporized molar present of the mixture at the output of the evaporator is 90% and the remaining liquid 10% are then vaporized in contact with the compressor unit. This percent may be lower in operating conditions where the compression power is high. Generally, the vaporized molar fraction of the mixture at the output of the evaporator will be higher than 80% and lower than 97%.

What is claimed as the invention is:

1. In a process for the extraction of heat from a first fluid to cool the fluid and for the addition of heat to a second fluid to heat the second fluid, wherein the process utilizes a working fluid; a compressor for compressing the working fluid; the compressor being in a hermetic container and having a suction zone and a discharge zone; a first heat exchanger for thermally contacting the first fluid with the working fluid to cool the first fluid and to add heat to the working fluid for vaporizing the working fluid; a second heat exchanger for thermally contacting the second fluid with the working fluid to heat the second fluid by removing the heat from the working fluid for condensing the working fluid, and an expansion valve for cooling the working fluid, the improvement comprising the steps of:

(a) composing the working fluid of at least two non-azeotropic components:

(b) passing the condensed working fluid through the first heat exchanger to partially vaporize said condensed working fluid and to produce a liquid-vapor mixture;

(c) thermally contacting the liquid-vapor mixture of step (b) with the hermetic container surround the compressor at a point in proximity with the suction zone and circulating the mixture in a sealed path around the container while progressively flowing the mixture nearer to the discharge zone and discontinuing contact of the mixture with the container at a location relatively near the discharge zone to extract heat from the compressor and to continue vaporization of the liquid-vapor mixture to produce a finally vaporized mixture;

(d) compressing the finally vaporized mixture of step (c) while extracting heat from the compressor as recited in step (c) to produce a compressed mixture;

(e) thermally contacting the second fluid with the compressed vaporized mixture in the second heat exchanger to heat the second fluid and condense the compressed mixture so as to produce a condensed mixture;

(f) expanding the condensed mixture, and (g) performing step (b)–(f) cyclically using the working fluid mixture of step (a).

2. A process according to claim 1 wherein the vaporized molar fraction of the working fluid, at the output of the evaporator, ranges from 80% to 97%.

3. A process according to claim 1, wherein the working fluid comprises a major constituent whose molar fraction is higher than 75%.

4. A process according to claim 1, wherein the working fluid comprises R22 as major constituent and R114 or R142b as minor constituent.

5. A process according to claim 1, wherein the working fluid comprises R22 as major constituent and R114 or R142b and R23 as minor constituents.

6. A process according to claim 1, wherein, the liquid-vapor mixed working fluid is in heat-exchange contact with the walls of the compression system through helical turns wound around at least one part of the walls of said compression system.

7. A process according to claim 1, wherein, the liquid-vapor mixed working fluid is in heat-exchange contact with the walls of the compression system through a tight jacket covering at least one part of the walls of said system.

8. A process according to claim 1, wherein the compression system comprises an external jacket destined to the cirulation of the working fluid and whose wall in contact with said system has a greater surface than that of the external wall of said jacket.

9. The process of claim 1, wherein the sealed path is defined by a helical tube surrounding the container.

10. The process of claim 1, wherein the sealed path is defined by a jacket surrounding the container.

11. The process of claim 1, wherein the working fluid is a mixture of halogenated hydrocarbons.

* * * * *

UNITED STATES PATENT AND TRADEMARK OFFICE

CERTIFICATE OF CORRECTION

PATENT NO. : 4,680,939

DATED : July 21, 1987

INVENTOR(S) : Alexandre Rojey et al

It is certified that error appears in the above-identified patent and that said Letters Patent is hereby corrected as shown below:

Column 7, Claim 1, Line 48:

reads: "step (b) with the hermetic container surround the"

should read: --step (b) with the hermetic container surrounding the--

Signed and Sealed this

Thirteenth Day of October, 1987

*Attest:*

DONALD J. QUIGG

*Attesting Officer*

*Commissioner of Patents and Trademarks*